United States Patent [19]

Porter et al.

[11] Patent Number: 4,608,788

[45] Date of Patent: Sep. 2, 1986

[54] ADJUSTABLE OVERHANG PANEL FOR BUILDING EAVE

[75] Inventors: William H. Porter, P.O. Box 249, Saugatuck, Mich. 49453; Cynthia F. McKean, Saugatuck, Mich.

[73] Assignee: William H. Porter, Saugatuck, Mich.

[21] Appl. No.: 557,969

[22] Filed: Dec. 5, 1983

[51] Int. Cl.[4] ..... E04B 7/16

[52] U.S. Cl. ..... 52/64; 52/75; 52/94

[58] Field of Search ..... 52/66, 68, 74, 94, 95, 52/96, 198, 262, 263, 75, 78, 64; 47/17, 28 R; 160/48, 49, 84 R, 105; 312/333

[56] References Cited

U.S. PATENT DOCUMENTS

| | | | |
|---|---|---|---|
| 1,482,059 | 1/1924 | Zimmer | 160/84 R |
| 1,973,029 | 9/1934 | Walston | 52/64 |
| 2,094,801 | 10/1973 | Nass | 52/64 |
| 2,565,545 | 8/1951 | Card | 160/58 R |
| 2,694,231 | 11/1954 | Bermejo | 52/6 |
| 3,137,967 | 6/1964 | Flieth | 52/94 |
| 3,206,903 | 9/1965 | Johnson | 52/94 |
| 3,815,299 | 6/1974 | Sorensen | 52/66 |
| 4,179,857 | 12/1979 | Danford | 52/71 |
| 4,195,455 | 4/1980 | Chalmers et al. | 52/94 |
| 4,237,672 | 12/1980 | Peterson | 52/95 |

FOREIGN PATENT DOCUMENTS

| | | | |
|---|---|---|---|
| 1162997 | 2/1964 | Fed. Rep. of Germany | 52/94 |
| 2445838 | 4/1976 | Fed. Rep. of Germany | 52/66 |
| 2610398 | 9/1977 | Fed. Rep. of Germany | 52/66 |
| 1004559 | 3/1983 | U.S.S.R. | 52/199 |

OTHER PUBLICATIONS

William K. Langdon, Movable Insulation, pp. 200–205, 218–220, Rodale Press, Emmaus, Pa.

*Primary Examiner*—John E. Murtagh
*Assistant Examiner*—Andrew Joseph Rudy
*Attorney, Agent, or Firm*—Emrich & Dithmar

[57] ABSTRACT

An adjustable overhang panel positioned on the eave of a roof of a building which can be extended to provide shade in the summer or retracted in the winter for increased sun exposure is disclosed. The lateral edges of a rigid panel are slidably positioned within parallel tracks which may be incorporated in extensions of the roof rafters. When extended, the panel is maintained in position by gravity. The panel includes an extended lip portion on the inner edge thereof for securely engaging inner portions of each of the parallel tracks for maintaining the panel in a stable, retracted position. The present invention is applicable to new buildings as well as existing structures by extending the roof rafters as support for the parallel tracks within which the overhang panel is positioned.

3 Claims, 4 Drawing Figures

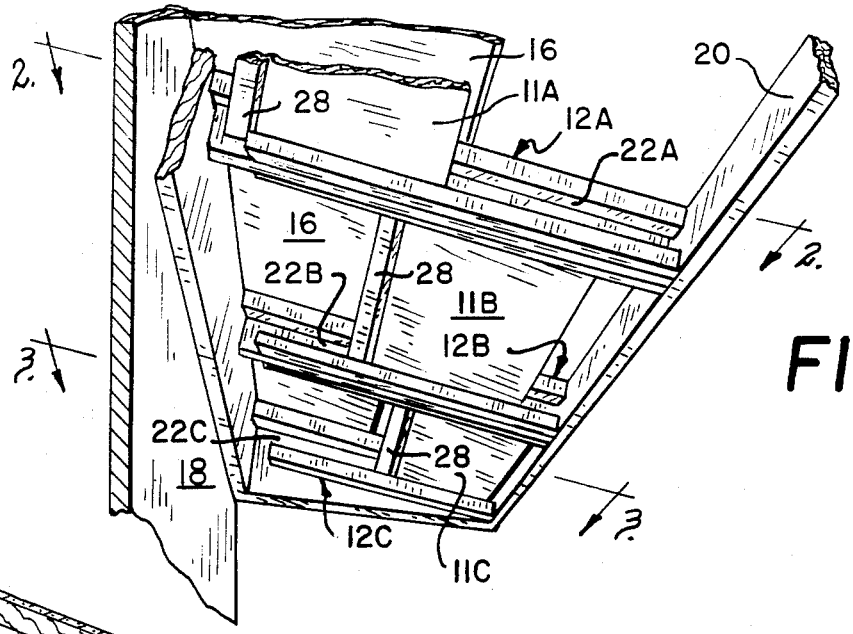
FIG. 1
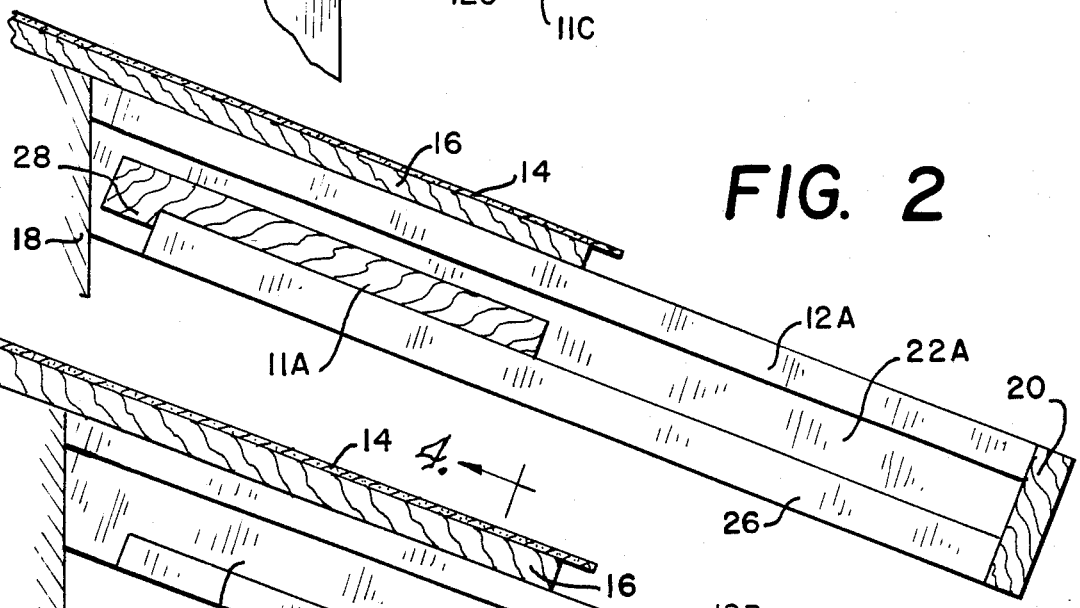
FIG. 2
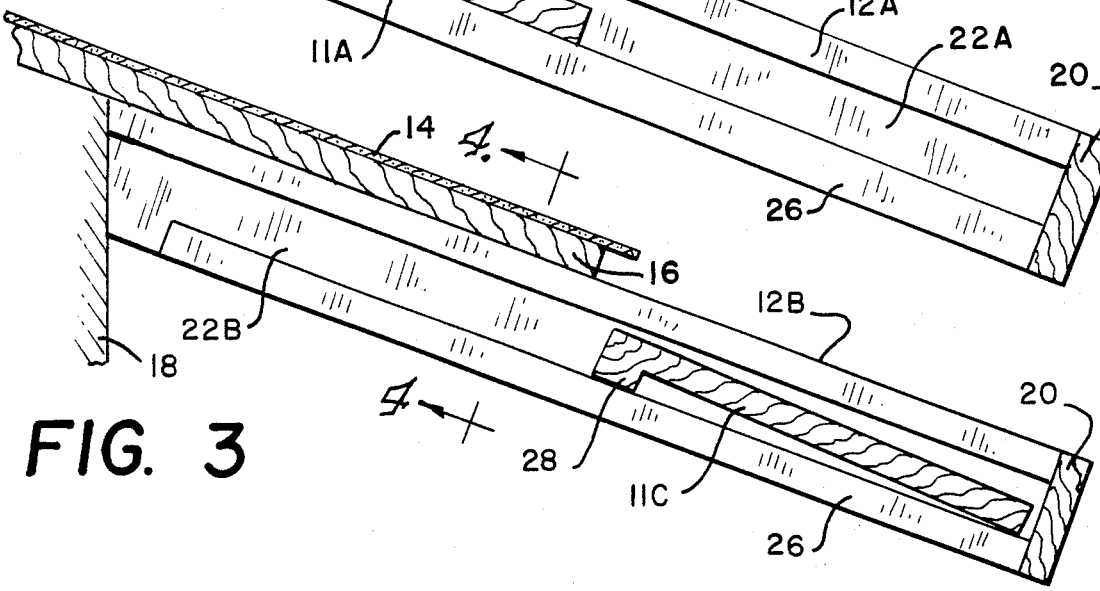
FIG. 3
FIG. 4
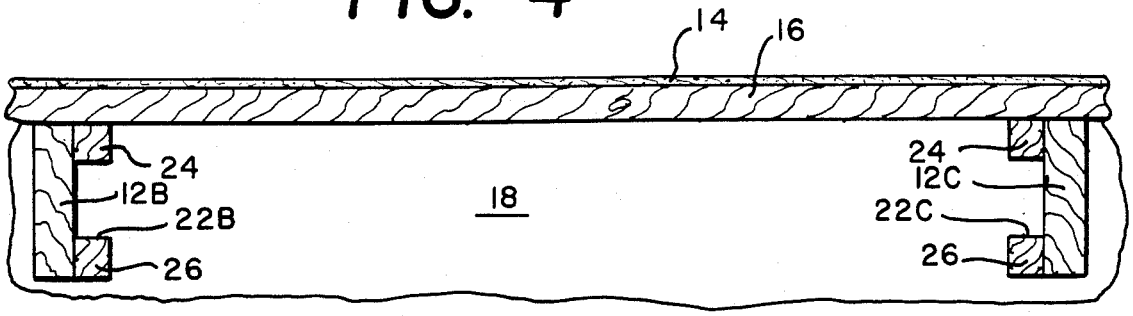

ADJUSTABLE OVERHANG PANEL FOR BUILDING EAVE

BACKGROUND OF THE INVENTION

This invention relates generally to building structures and is particularly directed to a displaceable roof eave structure which permits sun exposure of the outer walls of a building to be adjusted as desired.

One approach to regulating the temperature within a building involves controlling the amount of exposure to the sun of the building. The prior art discloses various devices for adjusting building shade such as awnings and removable slats in buildings employing passive solar heating. Awnings have, of course, proven to be a reliable means for shading the side, or particularly the windows, of a building. However, awnings generally must be taken down when not in use for extended periods such as during the winter in order to prolong their use. This typically involves considerable work and in some cases makes the use of awnings impractical. In addition, the structure of awnings, even of the nonfabric type, is susceptible to environmental damage such as by high winds. The removable slats typically utilized in passive solar heating systems are also generally difficult to remove and replace and thus do not allow for ease of adjustment of building shade.

The prior art discloses various adjustable shading devices. One approach is described in U.S. Pat. No. 2,694,231 to Bermejo involving a generally horizontal, retractable canopy for covering an automobile. The canopy is displaced in a generally horizontal direction by means of a manually operated rack and pinion combination. U.S. Pat. No. 4,179,857 to Danford discloses a hinged eave assembly for a sectional or modular structure which permits the eave of the structure to be displaced rotationally upward over the roof for transport in reducing the effective width of the structure to conform with state highway regulations. U.S. Pat. No. 2,565,545 to Card discloses an expansible awning which may be increased or decreased in width or length to permit it to cover a space of any required size, shape or contour. The structure includes a tubular, telescoping framework for supporting the covering material. By selectively adjusting the length of the various telescoping members, the size of the awning material support frame may be adjusted as desired. U.S. Pat. No. 2,367,695 to Hill discloses a knockdown or collapsible structure which includes a plurality of panels formed of plywood and supported upon and secured to a collapsible metallic frame.

U.S. Pat. No. 2,094,801 to Mass discloses a movable roof for a garden which includes frameless transparent roof-plates slidably positioned on and supported by a framework consisting of upright and supporting rails. The displaceable roof-plates are positioned in rows which are arranged to slide on the supported rails and when opened can be placed one above the other in uncovering a large part of the area of the garden. A manually operated pulley and rope combination permits the roof-plates to be slidably displaced along an upper portion of the framework for selectively covering and uncovering portions of the garden. All of the aforementioned structures are complex and expensive and do not provide an easily adjusted means for selectively controlling sun exposure on the outer wall of a building structure.

Accordingly, the present invention is intended to overcome the aforementioned limitations of the prior art by providing an inexpensive, easily manipulated, and structurally sound means for controlling the exposure of the lateral portions of a building to the sun. The adjustable overhang panel of the present invention may be easily positioned in a fully extended configuration to provide maximum shading of the building as in summer, and may be just as easily repositioned in a stable, retracted position where it is protected from the elements and does not provide any shade for the building to which it is attached.

OBJECTS AND SUMMARY OF THE INVENTION

Accordingly, it is an object of the present invention to control the temperature within a building by regulating solar exposure of the building's outer walls.

It is another object of the present invention to provide movable means mounted to the eave of a building for controlling the exposure of the building's outer walls to the sun.

Yet another object of the present invention is to provide an adjustable eave structure for controlling building sun exposure which is adapted for both new and existing structures.

A further object of the present invention is to provide an extendable roof overhang structure for adjustably shading the outer walls of a building.

These and other objects are accomplished by the present invention which contemplates a rigid panel coupled to and supported by the overhanging portion, or eave, of a roof. The panel is mounted in parallel tracks in extensions of the roof rafters and is continuously displaceable from a first retracted position, where it is nested beneath the roof overhang to a second extended position where it forms an extension of the roof overhang. When extended, the panel is maintained in stable position by gravity. When retracted, an extended lip on an inner edge of the panel engages a portion of the roof overhang structure for stable and secure positioning of the panel where it is protected from the elements. The overhang panel is lightweight and easily positioned by hand as desired. The present invention is applicable to new as well as existing structures by merely extending the roof rafters to support the overhang panel.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a lower perspective view of a structure employing several adjustable overhang panels in accordance with the present invention;

FIG. 2 is a sectional view of the adjustable overhang panel structure shown in FIG. 1 taken along sight line 2—2 therein;

FIG. 3 is a sectional view of the adjustable overhang panel structure shown in FIG. 1 taken along sight line 3—3 therein; and FIG. 4 is a sectional view of the adjustable overhang panel structure shown in FIG. 3 taken along sight line 4—4 therein.

DESCRIPTION OF THE PREFERRED EMBODIMENT

Referring to the drawings, there are shown various views of an overhang panel structure 10 in accordance with the present invention.

FIG. 1 shows a lower, perspective view of the overhang panel structure 10 positioned adjacent a building wall 18 for providing shade thereto. Building wall 18 may include a window, or windows, which can be shaded by means of the overhang panel structure 10 of the present invention. The overhang panel structure 10 shown in FIG. 1 is provided with three slidable panels 11A, 11B and 11C shown in various positions within the supporting structure. For example, panel 11A is shown in the fully retracted position, panel 11C is shown in the fully extended position, and panel 11B is shown in an intermediate position. The overhang panel structure 10 of the present invention may include a single slidable panel or any number of slidable panels depending upon the area to be shaded. In addition, the shape of the slidable panels and their configuration relative to one another is a function of the geometry of the building to be shaded and does not represent a limitation of the present invention.

Each of the slidable panels 11A, 11B and 11C is positioned between and supported by respective adjacent extended roof rafters 12A, 1B and 12C. An additional extended rafter is, of course, required to support slidable panel 11A, however, this has been omitted from FIG. 1 for the sake of clarity. The extended rafters 12A, 12B and 12C merely represent extensions of the existing rafters and thus permit the overhang panel structure 10 of the present invention to be easily installed in existing building structures. A new building may, of course, be provided with extended rafters as shown in FIG. 1 over which the roof eave 16 does not fully extend to permit installation of the overhang panel structure 10 of the present invention.

Referring to FIGS. 2, 3 and 4 in combination with FIG. 1, it can be seen that each of the slidable panels 11A, 11B and 11C positioned between adjacent extended rafters 12A, 12B and 12C are maintained in position by means of a respective slide track 22A, 22B and 22C. For simplicity sake, the slide tracks on opposite, facing sides of a given extended rafter are assigned the same element number. As shown in FIG. 4, each facing pair of slide tracks 22B, 22C is positioned on lateral, facing surfaces of adjacent extended rafters 12B and 12C, respectively. Slide tracks 22B and 22C are respectively formed from the combination of respective extended rafters 12B and 12C in combination with upper and lower guide strips 24, 26. A slidable panel is positioned within slide tracks 22B and 22C and may be easily displaced along the length thereof. As shown in FIGS. 2 and 3, a distal portion of each of the lower guide strips 26 extends to the end of a respective extended rafter. However, the proximal end portion of the lower guide strips 26 extends in close proximity to, but does not abut, the building wall 18. The space thus present between the proximal end portion of a respective lower guide strip 26 and the building wall 18 serves as a retaining means for securely maintaining a slidable panel in a fully retracted, or withdrawn, position. As can be seen in the figures, each of the slidable panels 11A, 11B and 11C includes a retainer lip 28 on its lower inner edge proximally located with respect to the building wall 18. The retainer lip 28 extends downward from the proximal edge of each of the slidable panels 11A, 11B and 11C and is positioned within the space between building wall 18 and the lower guide strip 26 of a respective slide track. The retainer lip 28 thus engages the proximal edge portion of the lower guide strip 26 preventing the slidable panels 11A, 11B and 11C from being displaced downward along extended rafters 12A, 12B and 12C. In this position, the slidable panels 11A, 11B and 11C do not shade building wall 18 from exposure to the sun and are themselves protected from the elements by being positioned immediately beneath the eave portion 16 of the roof 14.

Positioned on the distal end portions of each of the extended rafters 12A, 12B and 12C is a retainer bar 20. Retainer bar 20 serves to securely confine a respective slidable panel within its associated slide track by preventing it from being displaced from the space between adjacent extended rafters. The slidable panels 11A, 11B and 11C are maintained in the extended position by gravity and their secure engagement within adjacent slide tracks prevents them from being damaged or displaced out of position by environmental factors, e.g., the wind. In a preferred embodiment, the slidable panels are comprised of wood covered by a thin sheet of metal such as aluminum. Each of the slidable panels 11A, 11B and 11C is easily movable between the extended and retracted positions by merely lifting the panel upward within the slide tracks and moving it in the direction desired. This can be done either by hand or by means of a pole-like structure, e.g., a broom handle, when the roof eave is positioned beyond normal reach. In moving a panel from the extended to the retracted position the object used to displace the panel is positioned at the juncture of the lower surface of the panel and its retainer lip 28. By thus engaging the panel, it may be easily moved upward and positioned such that retainer lip 28 is located in the space between the building wall 18 and the proximal end of an adjacent lower guide strip 26.

There has thus been shown an adjustable overhang panel slidably mounted to the rafters of a building in the overhang portion of its roof which is easily displaceable between an extended and a retracted position for either shading or exposing a lateral wall of the building to the sun. The slidable overhang panel may be securely configured in either position and when in the retracted position, such as during the winter, is nested beneath the roof eave for protection from the elements.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Structural means supported by a building having at least one lateral wall, said structural means comprising:

first and second spaced, parallel beam rafters, each of said beam rafters having a length and also having a distal end portion extending beyond said lateral wall and recessed portions on respective facing surfaces thereof, wherein said beam rafters are inclined downward in proceeding toward the distal end portions thereof and wherein respective proximal ends of said recessed portions thereof do not extend to said lateral wall;

a roof structure positioned upon and supported by said first and second beam rafters and including an eave portion extending beyond said lateral wall to an intermediate position along the length of said first and second beam rafters; and a panel positioned between and supported by said first and second beam rafters, said panel continuously displaceable between a first position adjacent the distal end portions of said beam rafters and a second position adjacent said lateral wall and beneath the eave portion of said roof structure, said panel including lip means on an edge portion thereof proximal to said lateral wall, wherein with said lip means positioned within the space between said lateral wall and the recessed portions of said beam rafters and engaging the respective proximal ends of the recessed portions of said beam rafters, said panel is securely maintained in said second position by gravity.

2. Structural means in accordance with claim 1 wherein said recessed portions are each defined by respective pairs of upper and lower guide strips positioned on facing surfaces of said beam rafters and between which lateral edge portions of said panel are positioned.

3. Structural means in accordance with claim 1 wherein said panel is comprised of a flat wooden structure having a sheet metal surface.

* * * * *